US006392470B1

(12) United States Patent
Burstein et al.

(10) Patent No.: US 6,392,470 B1
(45) Date of Patent: May 21, 2002

(54) BANDGAP REFERENCE VOLTAGE STARTUP CIRCUIT

(75) Inventors: Amit Burstein, Tewksbury; Daniel Shkap, Cambridge, both of MA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/670,589

(22) Filed: Sep. 29, 2000

(51) Int. Cl.[7] ..... G05F 1/10
(52) U.S. Cl. ..... 327/539; 327/541
(58) Field of Search ..... 327/539, 540, 327/541, 542, 543; 323/313, 314, 315

(56) References Cited

U.S. PATENT DOCUMENTS

| | | | | |
|---|---|---|---|---|
| 3,648,154 A | | 3/1972 | Frederiksen et al. | 323/313 |
| 4,339,707 A | | 7/1982 | Gorecki | 323/313 |
| 4,684,878 A | * | 8/1987 | Giordano | 323/279 |
| 4,857,823 A | | 8/1989 | Bitting | 323/314 |
| 5,084,665 A | * | 1/1992 | Dixon et al. | 323/281 |
| 5,087,830 A | | 2/1992 | Cave et al. | 327/359 |
| 5,545,978 A | | 8/1996 | Pontius | 323/313 |
| 5,610,506 A | * | 3/1997 | McIntyre | 323/313 |
| 5,686,823 A | * | 11/1997 | Rapp | 323/313 |
| 6,034,562 A | * | 3/2000 | Bonet et al. | 327/541 |

* cited by examiner

*Primary Examiner*—Matthew Smith
*Assistant Examiner*—Paul Dinh
(74) *Attorney, Agent, or Firm*—Connolly Bove Lodge & Hutz LLP

(57) ABSTRACT

The invention relates to a device for transitioning a bandgap reference circuit to its operational mode, of supplying a reference voltage, when power is supplied to the combined circuits. The device is comprised of a supply-independent biasing circuit that is electrically connected to a start-up circuit and supports the start-up circuit's ability to cause a bandgap reference circuit to transition to its operational mode for any supply voltage that supports the bandgap reference circuit's operational mode.

9 Claims, 1 Drawing Sheet

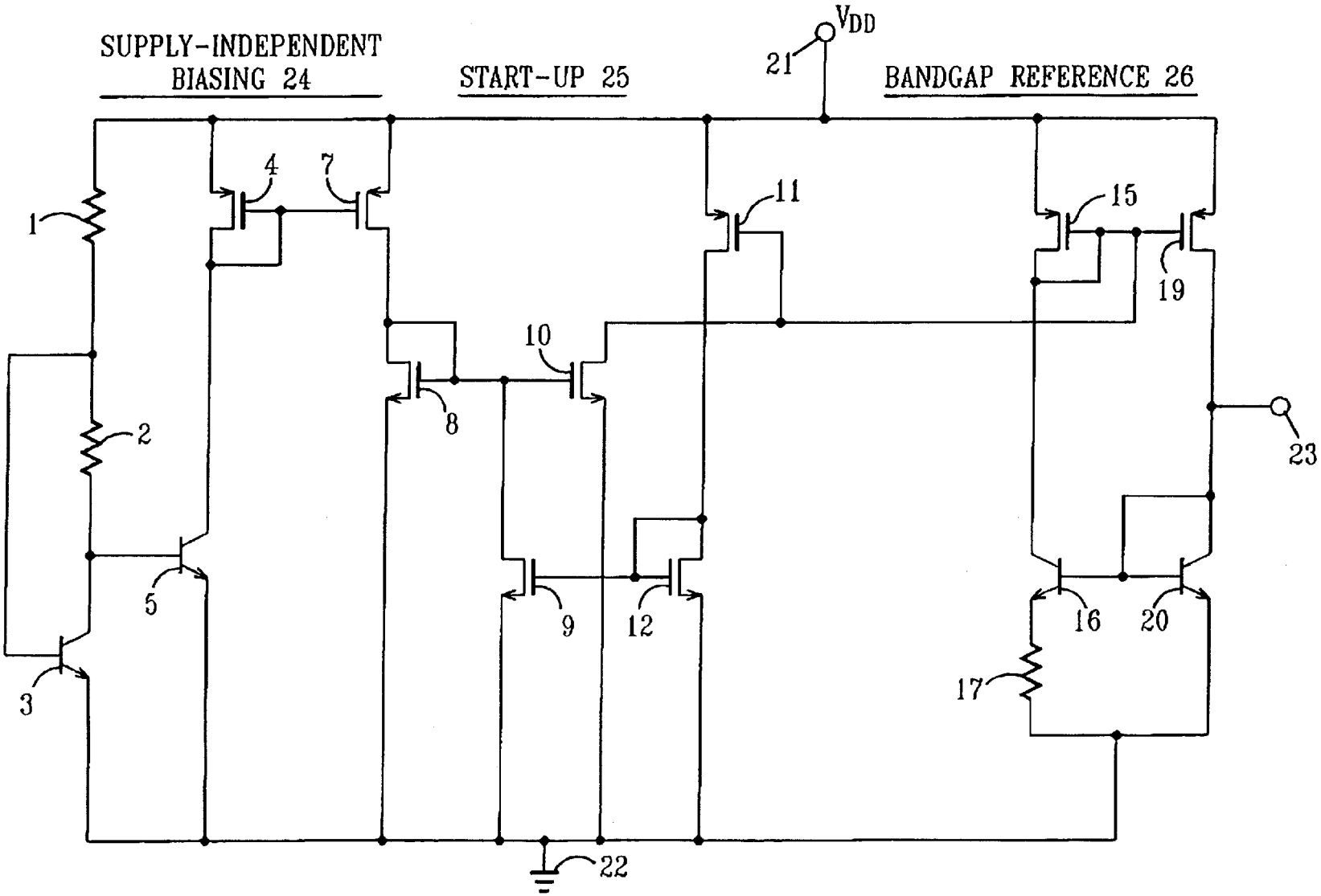
SUPPLY-INDEPENDENT BIASING 24
START-UP 25
BANDGAP REFERENCE 26
$V_{DD}$
21
22
23
1
2
3
4
5
7
8
9
10
11
12
15
16
17
19
20

BANDGAP REFERENCE VOLTAGE STARTUP CIRCUIT

FIELD OF THE INVENTION

The present invention is directed to bandgap reference circuits which provide a reference voltage independent of temperature. Specifically, a start-up circuit for a bandgap reference circuit is described whose operation is independent of power supply variations, which is an especially useful feature in battery operated circuits.

BACKGROUND OF THE INVENTION

Bandgap reference circuits are used in numerous RF analog circuit applications to provide a very stable reference voltage. For example, a wireless, radio frequency (RF) telephone is typically operated with a battery capable of generating a raw voltage between 2.7 to 5.5 volts, depending upon its state of discharge. Many of the circuit elements comprising the telephone, such as a voltage controlled oscillator, cannot operate properly without a stable and accurate reference voltage. Although a bandgap reference circuit can provide an accurate and stable reference, it has its own operational deficiencies.

A bandgap reference circuit has two stable states, an off state, that does not provide a reference voltage, and an operational state, that does. When power is applied to a bandgap circuit, the circuit enters the off state, in which no current flows through the bandgap reference circuit. The bandgap reference circuit remains in the off state until an external circuit forces it to transition to the operational state. Once the operational state has been established, the external start-up circuit must be electrically disconnected from the bandgap reference circuit so that the start-up circuit no longer influences the circuit operation.

SUMMARY OF THE INVENTION

The invention provides a start-up circuit for a bandgap reference circuit that will perform its intended function irrespective of substantial voltage variations of a power supply. The invention is comprised of a bandgap reference circuit, a start-up circuit that is electrically connected to the bandgap reference circuit, and a supply-independent biasing circuit that is electrically connected to the start-up circuit. The start-up circuit forces the bandgap reference circuit to transition to its operational mode when power is supplied to the two circuits. A supply-independent biasing circuit is integrated with the start up circuit to provide the proper operation of the start-up circuit for any supply voltage that supports the bandgap reference circuit's operational state.

BRIEF DESCRIPTION OF THE DRAWINGS

An embodiment of the invention will now be further described in conjunction with drawing, in which:

FIG. 1 illustrates the circuit schematic of the preferred embodiment.

DETAILED DESCRIPTION OF THE INVENTION

The principal purpose of the combined circuits illustrated in FIG. 1 is to support the ability of the bandgap reference circuit 26 to produce a stable and accurate reference voltage to one or more circuits (not shown) of an electronic device. A bandgap reference circuit 26 provides a substantially invariant voltage when subjected to variations of temperature and power supply voltage. Although the bandgap concept is known in the prior art, the present invention provides a reliable means to get the bandgap reference circuit 26 started when a power source, having an inconsistent or a variable supply voltage VDD, is applied to the circuit through terminals 22, 21.

The start-up circuitry 25 shown in the embodiment of FIG. 1 can perform its function substantially independent of the particular supply voltage applied to the circuit. The bandgap voltage is created by the arrangement of NPN transistors 16 and 20, along with resistor 17. Output terminal 23 is connected to the collector of transistor 20. The voltage across resistor 17 equals the potential difference between the base-emitters of transistors 16 and 20. This potential difference, termed delta-Vbe, has a positive temperature coefficient, is affected by designing the emitter area and/or current of transistor 16 to be greater than that of the transistor 20. The potential across the base emitter junction of transistor 16 has a negative temperature coefficient. By proper selection of resistor 17, an emitter area ratio between that of transistors 16 and 20 together with a correct choice of the aspect ratio of PMOS transistors 15 and 19, the positive and negative temperature coefficients of resistor 17 and Vbe of transistor 16, respectively, cancel each other to induce a temperature independent voltage across terminal 23, the bandgap voltage.

P-type, MOS transistors 15 and 19 provide current to transistors 16 and 20, respectively. Current is first established through transistor 19, which causes transistor 20 and then transistor 16 to turn on. Once transistor 16 is turned on, transistor 15 begins conducting current and the combined currents, flowing through the drain-source junctions of transistors 15 and 19, are conducted to ground potential. The collector-emitter junction currents flowing through transistors 20 and 16 will be substantially equal when these transistors reach an operationally steady state. For transistors 16 and 20 to reach their steady state operating point, transistor 19 must minimally conduct a threshold level of current to transistors 16 and 20, to fully turn them on. This threshold level of current is reached only after the supply voltage 21 ramps up to its operational level.

Without a start-up circuit, the bandgap circuit will not operate because it may remain in a stable state where the current is zero. Under such a stable condition, the gates of PMOS transistors 15 and 19 are at the supply potential, and the bases of transistors 16 and 20, which is the bandgap output terminal 23, is at ground potential. The proper operating condition of the bandgap circuit occurs when the current through the drain of PMOS transistor 15 equals (delta-Vbe)/R. This condition is achieved when power is applied, and the start-up circuit pulls the gates of PMOS transistors 15 and 19 to ground, thereby allowing for current to flow. When the current through PMOS transistor 15 is (delta-Vbe)/R, NMOS transistor 10 is electrically disconnected from the bandgap, i.e. it ceases to provide drain current and the start-up circuit does not interfere with the proper operation of the bandgap circuit.

The electrical disconnection is achieved by the arrangement of transistors 11, 12 and 9. If the PMOS transistor 11 equals the size of PMOS transistor 15, and NMOS transistor 12 equals the size of NMOS transistor 9, when (delta-Vbe)/R, current will flow through PMOS transistor 15, PMOS transistor 11, NMOS transistor 12 and NMOS transistor 9. If the current in the drain of PMOS transistor 7 is smaller or equal to (delta-Vbe)/R, then all of the current from PMOS transistor 7 flows through NMOS transistor 9, and none flows through NMOS transistor 8. If no current flows in NMOS transistor 8, its gate to source potential becomes zero. Since NMOS transistor 8 and NMOS transistor 10 forms a current mirror, no current will flow in NMOS transistor 10.

The supply independent biasing assures that under wide variations in the power supply voltage, the current through the drain of PMOS transistor 7 will not exceed a particular value. The current in PMOS transistor 7 is set by the current NPN transistor 5, times the current mirror ratio between MPOS transistor 4 and PMOS transistor 7. Therefore, the current in NPN transistor 5 should be independent of supply variations. When power is applied, the Vbe of NPN transistor 3 will increase through the current provided by resistor 1. The base-emitter diode of NPN transistor 3 becomes forward biased, collector current I3 will flow. With supply variations, I3 will vary. However, if the value of resistor 2, R2, is such that R2=(kT)/q*I3) then the collector voltage of NPN transistor 3 will remain largely unaffected and consequently, the current in NPN transistor 5 will also be insensitive to variations in supply voltage. The reason that the collector voltage in NPN 3 is insensitive to variations in supply voltage is because the Vbe of transistor 5 equals the Vbe of transistor 3-kT/q. For small changes in I3 due to supply variations, the Vbe of transistor 5 remains fixed, because as I3 increases, raising Vbe of transistor 3, and the voltage drop across resistor 2 also increases by an equal amount resulting in a zero net change in the Vbe of transistor 5.

The start-up circuit 25 forces an initial current in the bandgap reference circuit by pulling down the gate voltage of transistors 15 and 19. The gate pull down is performed by N type, MOS transistor 10. When power is applied to the start-up circuit, a current is established in N-type, MOS transistor 8 and is mirrored to transistor 10. The drain of transistor 10 pulls down the gate voltages of transistors 15 and 19, establishing a current in the bandgap reference circuit through transistors 19 and 20, which is configured as a diode-connected device. The current in the bandgap reference circuit transistors 19 and 20 is mirrored to P-type, MOS transistor 11 and N-type, MOS transistors 9 and 12. Once the current has reached a threshold value in the bandgap reference circuit, such that the circuit is stabilized in the operational mode, the mirrored current conducted by transistors 11 and 12 generates a voltage potential across the gate-source junctions of transistors 9 and 12. This voltage is adequate to turn on transistor 9, thereby pulling down the voltage applied to the gates of N-type, MOS transistor 8 and transistor 10, thereby turning them off. With transistor 10 turned off, it no longer influences the current flowing through transistors 15 and 19 and has no further affect on the operation of the bandgap reference circuit.

Just as transistor 10 is turned off by the conduction of current through transistor 9, so too is transistor 8. The current previously conducted through the transistor 8 is subsequently conducted to ground potential through transistor 9.

The supply-independent, biasing circuit 24 ensures that the current through P-type, MOS transistor 7 and conducted to ground potential by either transistor 8 or 9, depending upon which one is alternatively turned on, remains constant even if the supply voltage drifts. Without this circuit, the start-up circuit may perform erratically when subjected to voltage variations of the power supply. For example, suppose the power supply voltage drifts upwards. As the supply voltage increases, the current conducted by transistor 7 may concomitantly rise. The increased current may increase the voltage potential developed across the drain-source junction of transistor 8 and thereby increase the voltage applied to the gates of transistors 8 and 10. A rise of the voltage potential applied to these gates may cause the transistors to remain on, when they should turn off, or turn on when they should remain off.

The supply-independent, biasing circuit 24 eliminates the potential for a drifting voltage supply to adversely affect the operation of the start-up circuit. It does this by regulating the current flow through transistor 7 as set forth above. As the supply voltage drifts up, the base voltage of NPN transistor 3 drifts up, as well. An increased base-emitter junction voltage on transistor 3 causes the collector current through transistor 3 to increase, allowing the base-emitter junction of NPN transistor 5 to remain at the same voltage potential. The increase in collector current is controlled by the selection of resistor 2 and resistor 1, so as to offset voltage variations produced by the power supply. The potential at the base of transistor 5 results in fixed current through P-type, MOS transistor 4 that is mirrored to transistor 7. Therefore, the voltage potential developed at the gate-source junctions of transistors 8 and 10 is independent of voltage variations of the power supply and is only influenced by the operation of the startup circuit.

The foregoing description of the invention illustrates and describes the present invention. Additionally, the disclosure shows and describes only the preferred embodiments of the invention but, as mentioned above, it is to be understood that the invention is capable of use in various other combinations, modifications, and environments and is capable of changes or modifications within the scope of the inventive concept as expressed herein, commensurate with the above teachings and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. A supply-independent circuit for transitioning a bandgap reference circuit to its operational mode of supplying a reference voltage, comprising:

a start-up circuit that is electrically connected to a bandgap reference circuit and causes said bandgap reference circuit to transition to its operational mode when power is supplied said bandgap circuit;

a supply-independent biasing circuit that is electrically connected to said start-up circuit for generating a constant current level for said start-up circuit to force said bandgap reference circuit to transition to its operational mode for a supply voltage of said bandgap reference circuit; and a start-up circuit disabling means for disabling said start-up circuit after said bandgap reference circuit has entered its operational mode.

2. The supply-independent circuit for transitioning a bandgap reference circuit to its operational mode of supplying a reference voltage of claim 1, wherein:

said supply-independent biasing circuit, said start-up circuit, and said bandgap reference circuit receive power from the same voltage supply.

3. The supply-independent circuit for transitioning a bandgap reference circuit to its operational mode of supplying a reference voltage of claim 1, wherein:

said supply-independent biasing circuit generates said constant current level for any supply voltage between 2.7 volts and 5.5 volts.

4. A bandgap reference circuit voltage generating circuit, comprising:

a pair of bipolar transistors having connected bases, an emitter of a first bipolar transistor of said pair being connected to the emitter of a second bipolar transistor of said pair through a first resistor, said second bipolar transistor emitter being also connected to a first terminal of a power supply, and second bipolar transistor having a base connected to a collector of said second bipolar transistor;

first and second MOS transistors serially connecting the collectors of each of said bipolar transistors to a second terminal of said power supply, respectively, said first MOS transistor having a gate connected to said second MOS transistor gate and to said first bipolar transistor collector;

a supply independent biasing circuit for generating a reference current that is stable with temperature;

a start-up circuit connected to gate connections of said first and second MOS transistors, said start-up circuit sharing a first current mirror circuit with said supply independent biasing circuit, for producing a pull down current substantially the same as said reference current for said first and second MOS transistors, so that said first and second transistors conduct a current to establish a band gap voltage at the collector of said second bipolar transistor; and a disable circuit forming a second mirror current circuit, said disable circuit inhibiting said pull down current when said second bipolar transistor is in a stable current carrying condition.

5. The bandgap reference circuit voltage generating circuit according to claim 4, wherein said start-up circuit comprises:

third and fourth MOS transistors serially connected between said first and second terminals forming one half of said first current mirror circuit with said supply independent biasing circuit producing a mirror current equal to said reference current;

a fifth MOS transistor connected from said first terminal to said first and second MOS transistor gale connections, and having a gate connected to said fourth MOS transistor gate and drain, whereby current through said third and fourth transistors establishes a current flow through said first and second MOS transistors permitting said first and second bipolar transistors to assume a stable state.

6. The bandgap reference circuit voltage generating circuit according to claim 5, wherein said disable circuit comprises:

sixth and seventh MOS transistors serially connected between said first and second terminals, said sixth and seventh MOS transistors forming a second current mirror with said second bipolar transistor and said second MOS transistor; and an eighth MOS transistor connected in series with a gate of said fifth transistor for disabling conduction by said fifth transistor in response to a mirror current produced from said second current mirror.

7. The bandgap reference circuit voltage generating circuit according to claim 4, wherein said supply independent bias circuit comprises:

a third bipolar transistor having an emitter connected to said first terminal;

a second resistor connected at one end to a collector of said third bipolar transistor and connected at a second end to a base of said third bipolar transistor;

a third resistor connected from said base of said third bipolar transistor to said second terminal;

a fourth bipolar transistor having a base connected to a collector of said third bipolar transistor; and a third MOS transistor connected between a collector of said fourth bipolar transistor and said second terminal; said third MOS transistor forming with said fourth bipolar transistor one half of said current mirror shared with said start-up circuit.

8. The bandgap reference circuit voltage generating circuit according to claim 7 wherein said second resistor has a value equal to KT/q times the current through said third bipolar transistor, where K is Boltzman's constant, T is temperature, and q is the change of an electron.

9. The bandgap reference circuit voltage generating circuit according to claim 4 wherein said first resistor is selected to have a value which compensated for temperature induced base emitter voltage changes of said first bipolar transistor.

* * * * *